United States Patent [19]

Sulfstede et al.

[11] Patent Number: 4,573,326

[45] Date of Patent: Mar. 4, 1986

[54] ADAPTIVE DEFROST CONTROL FOR HEAT PUMP SYSTEM

[75] Inventors: Louis E. Sulfstede; Carl Bergt; Robert W. Helt, all of Tyler, Tex.

[73] Assignee: American Standard Inc., New York, N.Y.

[21] Appl. No.: 698,057

[22] Filed: Feb. 4, 1985

[51] Int. Cl.[4] ..... F25D 21/06

[52] U.S. Cl. ..... 62/156; 62/128

[58] Field of Search ..... 62/156, 155, 140, 151, 62/160, 128

[56] References Cited

U.S. PATENT DOCUMENTS

| | | | |
|---|---|---|---|
| 3,950,962 | 4/1976 | Odashima | 62/156 |
| 4,104,888 | 8/1978 | Reedy et al. | 62/140 X |
| 4,373,349 | 2/1983 | Mueller | 62/156 |
| 4,406,133 | 9/1983 | Saunders et al. | 62/156 X |

FOREIGN PATENT DOCUMENTS

| | | | |
|---|---|---|---|
| 0024344 | 2/1979 | Japan | 62/156 |
| 0118549 | 9/1980 | Japan | 62/140 |

*Primary Examiner*—Harry Tanner

*Attorney, Agent, or Firm*—Ronald M. Anderson; Carl M. Lewis; William J. Beres

[57] ABSTRACT

A microcomputer based defrost control for a heat pump system that "learns" from previous defrost cycles to achieve optimum defrost control at each of a plurality of outdoor temperature ranges, even if the heat pump system operating parameters change due to system aging. At the conclusion of each defrost cycle, the control determines the differential temperature between the outdoor ambient air and the outdoor heat exchanger and compares that value to a value stored in microcomputer memory representing a previous best such post-defrost differential temperature for the same ambient air temperature range. The control then calculates a defrost differential temperature initiate value, corrected to compensate for any loss of defrost performance indicated by the current post-defrost cycle differential temperature. After a period of time during which a number of defrost cycles have occurred, the minimum post defrost differential temperature value for each ambient temperature range becomes the best performance measure of the defrost cycle for the heat pump system. The stored minimum values are reset to zero when the control and heat pump system are deenergized. When the system is again turned on, new optimum defrost initiate values are again determined over a period of time. In addition, various default conditions cause the control to initiate an extended defrost cycle. The control is programmed to alert the operator by lighting a lamp on the thermostat should such a fault condition occur.

28 Claims, 11 Drawing Figures

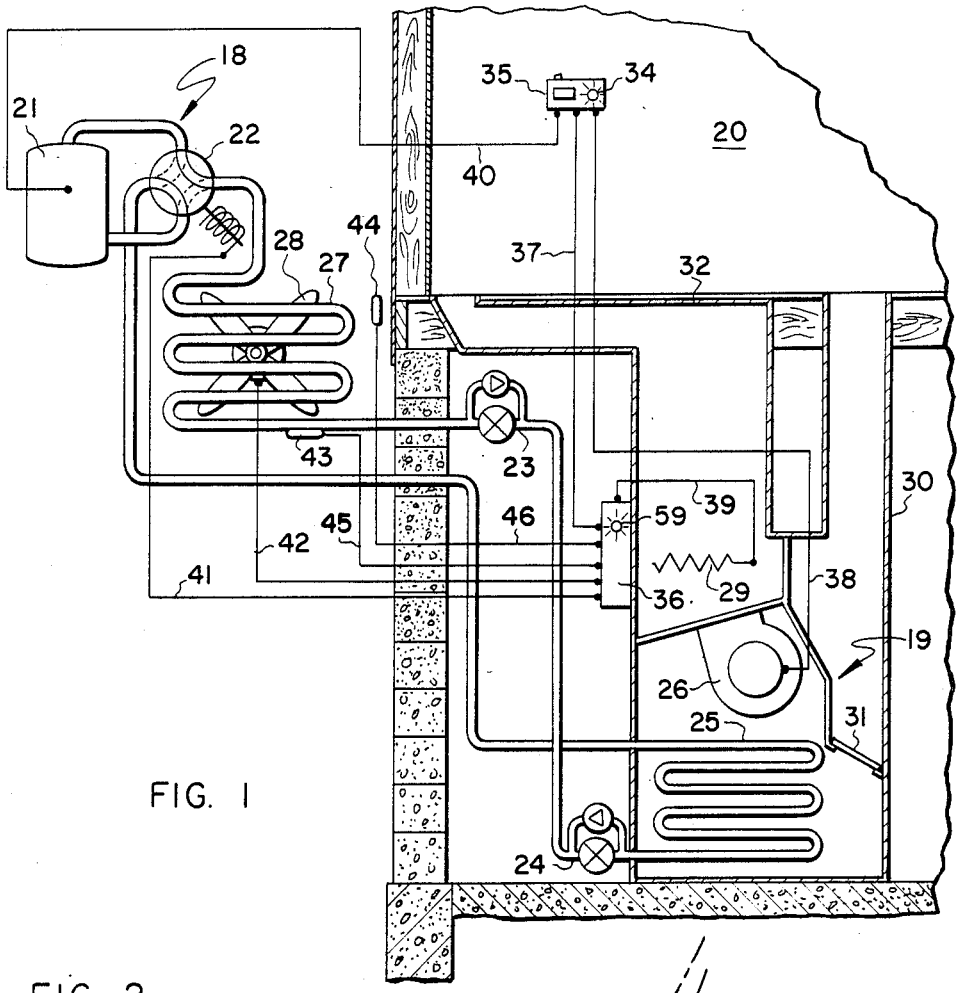
FIG. 1
FIG. 2
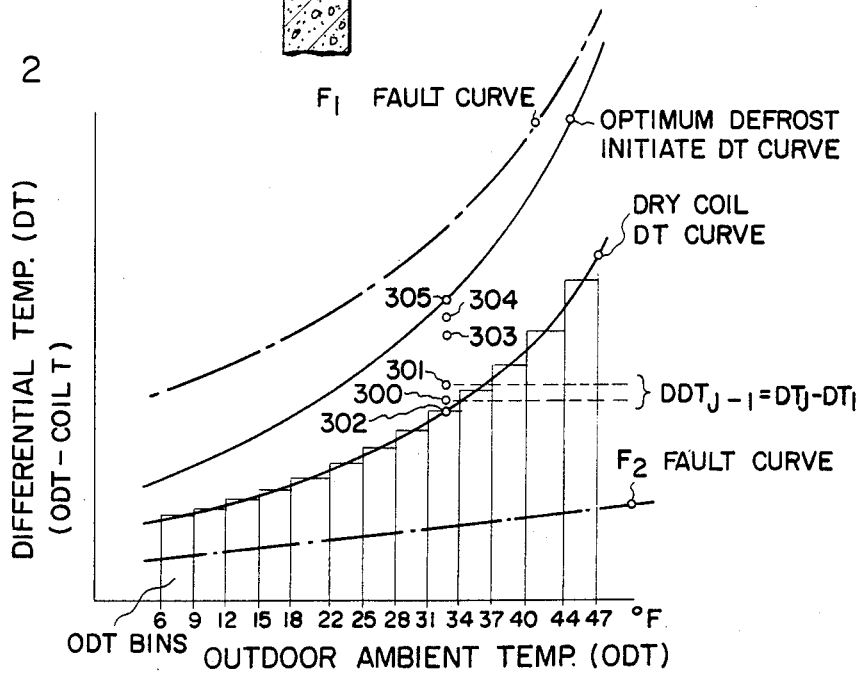

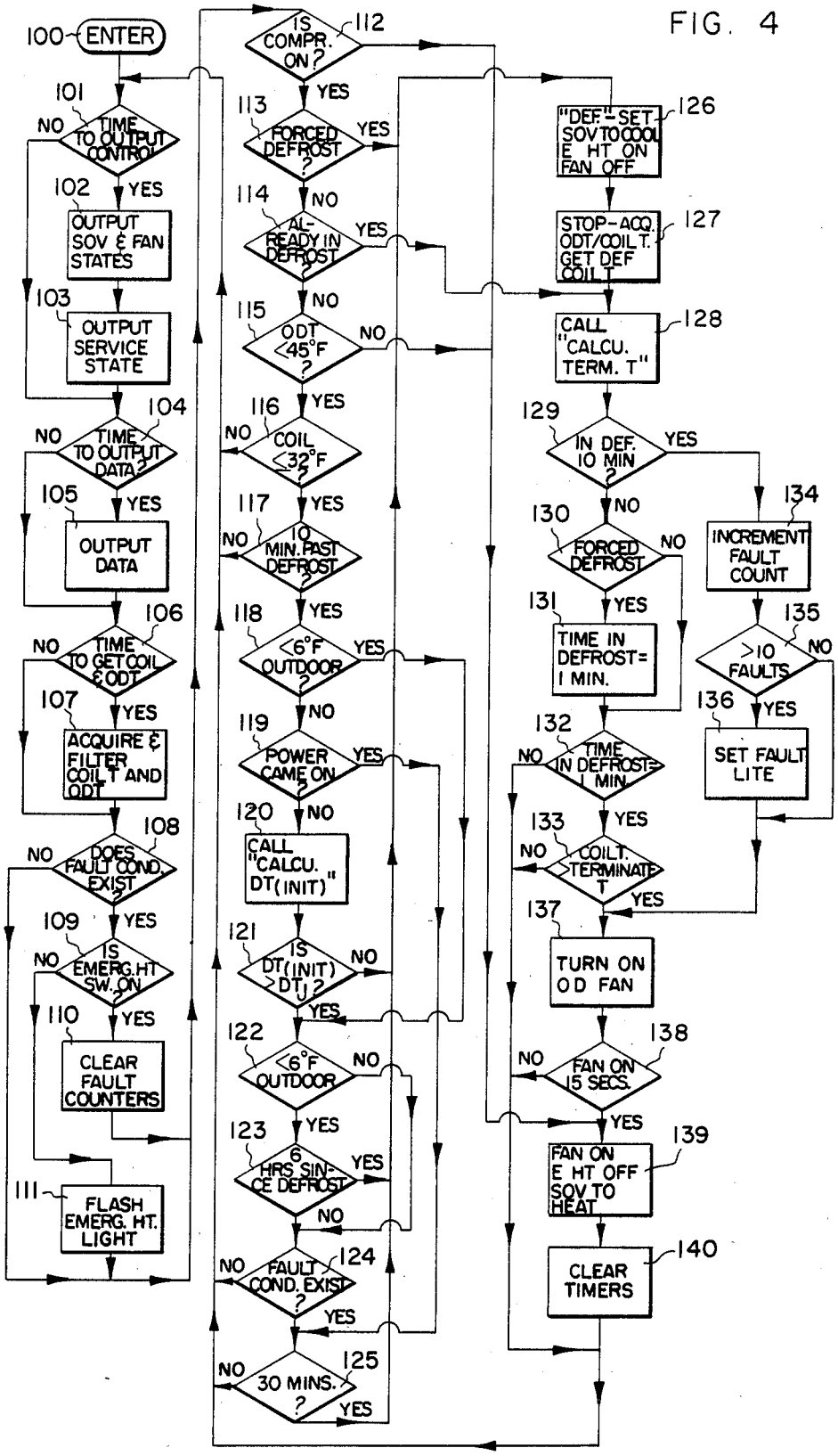
FIG. 4
100 ENTER
101 TIME TO OUTPUT CONTROL
NO
YES
102 OUTPUT SOV & FAN STATES
103 OUTPUT SERVICE STATE
104 TIME TO OUTPUT DATA
105 OUTPUT DATA
106 TIME TO GET COIL & ODT
107 ACQUIRE & FILTER COIL T AND ODT
108 DOES FAULT COND. EXIST
109 IS EMERG. HT SW. ON
110 CLEAR FAULT COUNTERS
111 FLASH EMERG. HT. LIGHT
112 IS COMPR. ON?
113 FORCED DEFROST ?
114 ALREADY IN DEFROST ?
115 ODT <45°F ?
116 COIL <32°F ?
117 10 MIN. PAST DEFROST ?
118 <6°F OUTDOOR ?
119 POWER CAME ON ?
120 CALL "CALCU. DT(INIT)"
121 IS DT(INIT) >DT ?
122 <6°F OUTDOOR
123 6 HRS SINCE DEFROST
124 FAULT COND. EXIST ?
125 30 MINS. ?
126 "DEF."-SET SOV TO COOL E HT ON FAN OFF
127 STOP-ACQ. ODT/COIL T. GET DEF COIL T
128 CALL "CALCU. TERM. T"
129 IN DEF. 10 MIN ?
130 FORCED DEFROST
131 TIME IN DEFROST= 1 MIN.
132 TIME IN DEFROST= 1 MIN.
133 COIL T. TERMINATE T
134 INCREMENT FAULT COUNT
135 >10 FAULTS
136 SET FAULT LITE
137 TURN ON OD FAN
138 FAN ON 15 SECS.
139 FAN ON E HT OFF SOV TO HEAT
140 CLEAR TIMERS

ADAPTIVE DEFROST CONTROL FOR HEAT PUMP SYSTEM

BACKGROUND OF THE INVENTION

TECHNICAL FIELD

This invention generally pertains to an automatic defrost control for a heat pump, and specifically to a defrost control that adapts to changes in the ambient conditions and to variations in the heat pump system that it controls.

BACKGROUND ART

If an air source heat pump is operating in the heating mode and the surface of the outdoor ambient heat exchanger temperature is less than 32° F. due to a relatively low outdoor air temperature the outdoor heat exchanger may accumulate frost and ice which eventually block air flow therethrough to such an extent that the heating capacity of the system is unable to meet the heating demand. It is common practice to periodically enter a defrost cycle in which heat from compressed refrigerant is used to melt the accumulated frost and ice. During the defrost cycle, the refrigerant condensed in the outdoor heat exchanger is vaporized in the indoor heat exchanger. This cools the air flowing through the indoor heat exchanger and it is necessary to use auxiliary heat to prevent the cooling of the comfort zone in which there is a heating demand. Due to the next energy waste involved in running the heat pump system in a defrost cycle, it is best that it not be implemented more often, nor for a longer period than necessary to maintain the heating efficiency of the system. It is thus preferable to initiate a defrost cycle only after sufficient frost and ice have accumulated on the outdoor heat exchanger to cause a problem in meeting the heating demand.

The prior art includes numerous schemes for sensing quantitatively the buildup of frost and ice on the heat exchanger, including for example: (a) a decrease in the rate of airflow through the outdoor coil; (b) an increase in outdoor fan motor current; (c) a change in the level of light transmitted across a passage in the coil or scattered by frost crystals on the coil; and (d) the differential temperature between the outdoor coil and the outdoor ambient air. Virtually all such prior art control schemes initiate a defrost cycle when the selected measured operating parameter exceeds a predetermined threshold value selected for the particular design heat pump system with which the defrost control is used. This generally requires that the control be calibrated for a specific heat pump system design, and does not provide any means for the control to adapt to changes in the system due to aging. Nor do such controls typically account for varying outdoor ambient temperatures, and their affect on frost buildup. As a result, defrost cycles can be initiated at inappropriate intervals, resulting in poor system performance and decreased operating efficiency.

One prior art system that provides some adaptivity in controlling defrost is disclosed in U.S. Pat. No. 4,373,349. The control disclosed therein initiates a defrost cycle if the mathematical product of the outdoor ambient air temperature and a pre-selected constant equals or exceeds the outdoor coil temperature. After the heat pump system has stabilized following a defrost cycle, a new constant and defrost initiate control line are determined based upon the current outdoor air temperature and outdoor heat exchanger temperature and the same parameters for clear coil conditions. Thus, the value of the constant which defines the slope of the linear defrost initiate control line may change after each defrost.

The defrost algorithm of the U.S. Pat. No. 4,373,349 presumes that at a given outdoor ambient temperature, the difference between the outdoor heat exchanger temperature and the outdoor ambient air temperature at the end of the last defrost cycle should increase 50% before a defrost cycle is again initiated. At other ambient temperatures, the defrost initiate value is linearly extrapolated. However, for a particular heat pump system, the optimum change may not be equal to 50%, nor may the percentage change necessarily be the same for all outdoor ambient air temperatures.

In consideration thereof, it is an object of this invention to control the defrost cycle of the heat pump in an energy efficient manner, wherein the control is automatically adaptable to a variety of heat pump designs.

It is a further object of the invention that the defrost control adapt to changes in the heat pump system as it ages, to maintain optimum system efficiency without requiring recalibration.

A still further object is that the control be truly adaptable for operation at various outdoor ambient temperatures, rather than relying on linear interpolation of performance at a substantially different ambient temperature.

Yet a still further object is that the control "learn" from previous defrost cycle results so that the parameters that determine when a defrost cycle should be effected approach an optimum value for each of a plurality of outdoor ambient air temperatures, thereby collectively defining an optimum defrost initiate curve for a given heat pump system.

These and other objects of the invention will be apparent from the description of the preferred embodiment that follows hereinbelow and by reference to the attached drawings.

SUMMARY OF THE INVENTION

This invention is a defrost control for a temperature conditioning system that includes an outdoor heat exchanger on which ice and frost may accumulate. An outdoor heat exchanger temperature sensor and an outdoor ambient air temperature sensor are connected to means for controlling the system to effect a defrost cycle to melt the ice and frost that have accumulated on the heat exchanger when it is used as an evaporator during operation in a heating mode.

The control means are responsive to the two temperature sensors, and initiate a defrost cycle if the current differential temperature between the outdoor ambient air and the outdoor heat exchanger exceeds a defrost initiate value. This value is calculated as a function of a "last" post defrost differential temperature between the outdoor ambient air and the outdoor heat exchanger determined by the control means following the last defrost cycle, during stable conditions before new frost has begun to form on the outdoor heat exchanger, and a minimum such differential temperature determined following previous defrost cycles at substantially the same outdoor ambient air temperature. This defrost initiate value is re-iteratively determined by the control means, and in successive defrost cycles, approaches an optimum value. Thus, the defrost initiate value adapts to changes in the temperature conditioning system to maintain an optimum defrost cycle as the system ages.

The control means include memory means for storing the minimum post-defrost cycle differential temperature associated with each of a plurality of outdoor air temperature ranges. This enables the defrost control to provide optimum defrost cycle operation in each range of outdoor ambient air temperature.

BRIEF DESCRIPTION OF THE DRAWINGS

FIG. 1 is a schematic diagram of a split-type heat pump system installed to heat or cool a structure, including the subject invention for controlling defrost of the outdoor heat exchanger.

FIG. 2 is a graph illustrating how the defrost control achieves an optimum value for initiating defrost as a function of the differential temperature between the outdoor ambient air and the outdoor heat exchanger for each of a plurality of outdoor ambient air temperature ranges and showing default curves associated with the control.

FIG. 4 is a flow chart illustrating the control logic used by the defrost control.

DESCRIPTION OF THE PREFERRED EMBODIMENT

Figure 3:
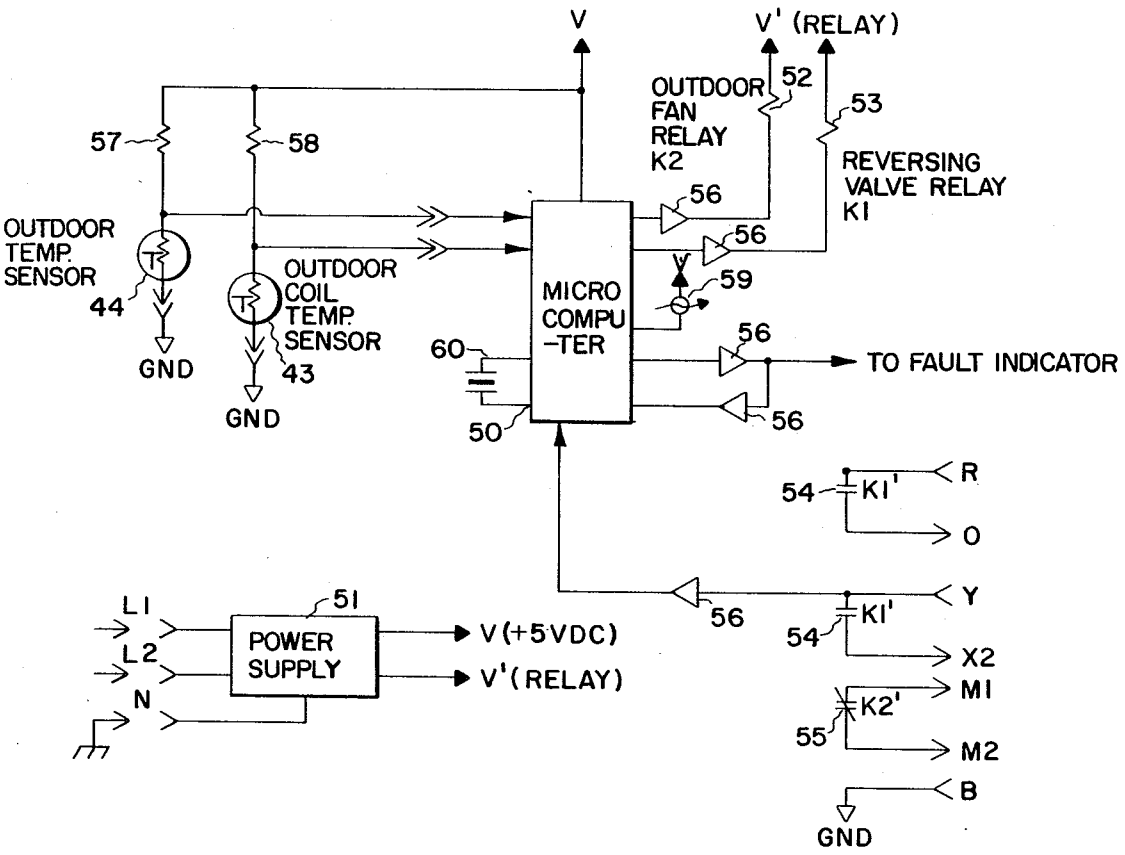
FIG. 3 is a simplified schematic block diagram of the defrost control.

With reference to FIG. 1, a generally conventional heat pump is shown configured with an outdoor unit 18 and an indoor unit 19. The indoor unit 19 of the heat pump system is arranged to provide temperature conditioned air to a comfort zone 20. The heat pump comprises a refrigerant vapor compressor 21, provided with a reversing valve 22 and expansion/bypass valves 23 and 24, such that the heat pump system can be selectively operated to either heat or cool air circulated through the comfort zone 20 by an indoor fan 26. In FIG. 1, reversing valve 22 is shown in the position used during the cooling and defrost cycles. The heat pump system further includes an indoor heat exchanger 25, an outdoor heat exchanger 27, and an outdoor fan 28. Electric heat is provided as an auxiliary heat source represented by element 29 for heating the comfort zone 20 when the refrigerant cycle heat pump is incapable of providing sufficient heat.

During operation in the heating mode, reversing valve 22 is switched over to its other position. The refrigerant vapor compressed by compressor 21 then flows through reversing valve 22 and into the indoor unit 19, where it is condensed as it passes through indoor heat exchanger 25 by heat transfer with air circulated into the comfort zone 20 by indoor fan 26. Cooler air is drawn from zone 20 through duct 30 and filter 31, and is supplied to the zone after being heated, through duct 32. Condensed refrigerant liquid from indoor heat exchanger 25 bypasses through expansion/bypass valve 24 and expands through expansion/bypass valve 23 into the outdoor heat exchanger 27. The outdoor fan/motor 28 moves outdoor ambient air through the outdoor heat exchanger 27 such that the refrigerant liquid is vaporized as it absorbs heat from the air. The refrigerant vapor thereafter returns through reversing valve 22 to the suction inlet of compressor 21.

While operating in the heating mode, the capacity and efficiency of an air source heat pump is substantially reduced when the outdoor ambient air temperature is relatively low. It is therefore a common practice to supply auxiliary heat to supplement the heating capacity of the heat pump under these conditions. In the preferred embodiment, electric heating elements 29 are disposed to heat air circulated into the comfort zone 20 by the indoor fan 26. Although only a single heating element 29 is shown in FIG. 1, this element is representative of one or more stages of electric heat, each stage capable of being selectively energized.

Air supplied to the comfort zone 20 may be selectively cooled rather than heated, by changing the position of the reversing valve 22 to that shown in FIG. 1. This interchanges the functions of the indoor and outdoor heat exchangers 25 and 27, respectively. In the cooling mode, the outdoor heat exchanger 27 serves as a condenser to condense the compressed refrigerant vapor supplied by compressor 21. The condensed liquid bypasses through expansion/bypass valve 23 and expands through expansion/bypass valve 24 into the indoor heat exchanger 25. The refrigerant liquid is vaporized in heat transfer relationship with air circulated into the comfort zone 20 by the indoor fan 26, thereby cooling the air. The vaporized refrigerant returns to the compressor 21, to repeat the cycle.

In the preferred embodiment, operation of the components heretofore described in primarily controlled by thermostat 35, mounted in comfort zone 20. However, unit controller 36 is able to selectively override the thermostat control of some of the electrical heat pump components by controlling the supply of electrical power to these components. Thermostat 35 is connected to the control 36 by a multiconductor cable 37. Each component of the heat pump system is likewise connected to control 36 as follows: heating elements 29 by means of leads 39, reversing valve 22 by means of leads 41, and outdoor fan 28 by means of leads 42. In addition, control 36 is also connected to thermistor 43 for sensing the outdoor heat exchanger temperature, and by leads 46 to thermistor 44 for sensing the outdoor ambient air temperature. Power supplied to the indoor fan 26 and to the compressor 21 is controlled by thermostat 37 by means of lead 38 and 40, respectively.

The subject invention is directed to the problems associated with defrosting the outdoor heat exchanger 27 to melt ice and frost which have accumulated thereon during operation of the heat pump system in the heating mode. Controller 36 includes control means responsive to the thermistors 43 and 44 for effecting control of the defrost cycle, as claimed herein, and in addition, may control the apparatus of the outdoor unit 18 and the indoor unit 19 during normal operation of the heat pump in the heating or cooling mode. In the preferred embodiment, the defrost cycle is initiated when unit controller 36 de-energizes the outdoor fan 28, and energizes the reversing valve 22, thereby interchanging the functions of the indoor and outdoor heat exchangers 25 and 27, respectively. Under these conditions, compressed hot refrigerant vapor is supplied to the outdoor heat exchanger 27 to melt the ice and frost that have accumulated on it. During the defrost cycle, the indoor heat exchanger 25 cools air that is supplied to the comfort zone 20 even though there is a demand for heat; however, controller 36 energizes auxiliary heating elements 29 as required to minimize cooling of air supplied to the zone 20.

Referring now to FIG. 3, a block diagram schematic of the unit controller 36 is shown comprising a microcomputer 50. Micrcomputer 50 includes a central processing unit (CPU), a read-only memory (ROM), a random-access memory (RAM), internal timers/counters, and an analog-to-digial (A-D) converter. In the preferred embodiment, microcomputer 50 is a Motorola Corporation Model MC 6805-R2, and includes 64 bytes of RAM and 2K bytes of ROM. Other similar microcomputers may be used. In addition, microprocessors may be used with external memory and other peripheral circuitry, as is well known to those skilled in the art. For purposes of disclosing the preferred embodiment of the subject invention, it is unnecessary to present details of the unit control 36 other than what is shown in FIG. 3.

Operational voltages used by the microcomputer 50 and associated circuit components are supplied by power supply 51 which is of generally conventional design. Power supply 51 receives source power over leads L1 and L2 from a line voltage source at either 120 or 240 volts AC or from the conventional control transformer with 24 volt AC output that is normally found in HVAC units. The output voltages from power supply 51 comprise a voltage V which is at +5 volts DC, and a voltage V′ used for actuating relay coils at 30 volts DC nominal.

Microcomputer 50 is provided with a time base reference for the internal timers. A crystal 60 is shown as the time base in the preferred embodiment, however other time base references, such as a RC circuit, known to those skilled in the art, may be used.

Voltages representing the outdoor ambient air temperature and the outdoor heat exchanger coil temperature are input to microcomputer 50 for conversion to digital values used in the algorithm for defrost control executed by control 36. Resistors 57 and 58 are connected in series with outdoor temperature sensor 44 and outdoor heat exchanger coil temperature sensor 43, respectively, and serve as a means for scaling the voltage developed across temperature sensors 43 and 44 as a function of the temperature they are exposed to.

Microcomputer 50 effects control of the defrost cycle by means of signals output to the outdoor fan relay K2 designated by reference numeral 52 and the reversing valve relay K1, designated by reference numeral 53. One side of each of relay coils 52 and 53 is connected to the V′ voltage output from supply 51, and the other side of each coil is connected to an output buffer/transistor switch 56, having an input from microcomputer 50. A logic level signal output from microcomputer 50 to the switch 56 connected to relays 52 and 53 is thus effective to actuate each relay in a selective fashion. Relays 52 and 53 are actuated when microcomputer 50 determines that a defrost cycle is necessary. Actuation of relay 52 closes the K1′ contacts designated by reference numeral 54. This allows a voltage present on terminal R to be applied to terminal O which is connected to the reversing valve contactor by leads 41, placing it in the same position used for the cooling cycle. Likewise, actuation of the outdoor fan relay K2 opens normally closed contacts K2′ designated by reference numeral 55, breaking a current path between terminals M1 and M2. This interrupts the flow of current to the outdoor fan 28 over the electrical lead 42. Closure of contact K1′ between terminals Y and X2 allows current to flow from a 24 volt AC level present at terminal Y into a contactor (not shown) connected to X2 to energize the auxiliary heat elements 29, via electrical leads 39.

Terminals F and Y are each connected to microcomputer 50 through buffer/transistor switches 56. Buffers 56 produce a 5 volt DC logic level when control voltages are present on terminals F and Y, and this logic level voltage permits microcomputer 50 to determine the status of the system and whether faults in the system operation may exist. For example, the input through buffer 56 from terminal Y enables the microcomputer 50 to determine if the compressor 21 has been energized.

Terminal F leads to a fault indicator 34 on thermostat 35. Both an input and an output buffer/transistor switch 56 are provided to connect terminal F to microcomputer 50. Terminal F functions to flash the defrost fault indicator 34 on thermostat 35 when a fault condition exists, as will be described hereinbelow. A reset of displayed faults can be effected by a switch (not shown) on the thermostat 35 following the occurrence of a defrost fault. An output signal from microcomputer 50 passing through output buffer/transistor switch 56 causes the fault indicator light 34 to flash if a defrost fault exists. When the operator switches the Emergency Heat Switch on thermostat 35 to the "On" position, a signal is input to microcomputer 50 through the input buffer/transistor switch 56, that causes the system to reset. In the preferred embodiment, the same indicator that is steadily lighted to indicate emergency heat mode is selected, is also used for the fault indicator 34. Likewise, the switch normally used to energize emergency heat is used as the reset switch for clearing a fault indication.

A service LED light 59 disposed on control 36 is directly driven by microcomputer 50 in the event that certain predetermined defrost fault conditions exist, generally before the conditions have been met necessary to cause fault indicator 34 on thermostat 35 to flash. Operation of both fault indicator 34 on thermostat 35 and service fault indicator 59 will be explained more fully below.

Figure 5:
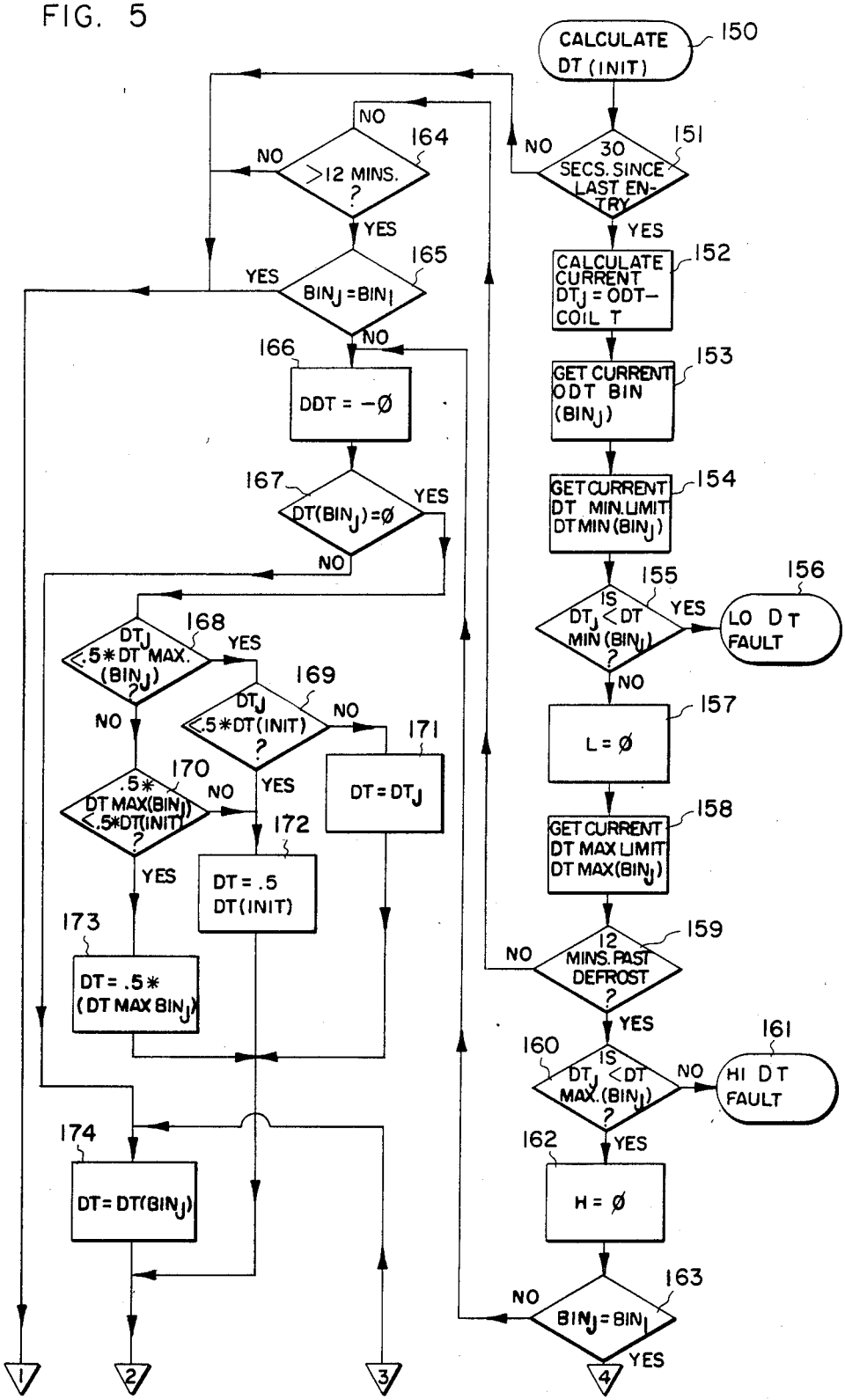
FIG. 5 is a flow chart illustrating the control logic used by a subroutine for calculating the differential temperature at which the control effects a defrost cycle.
Figure 5A:
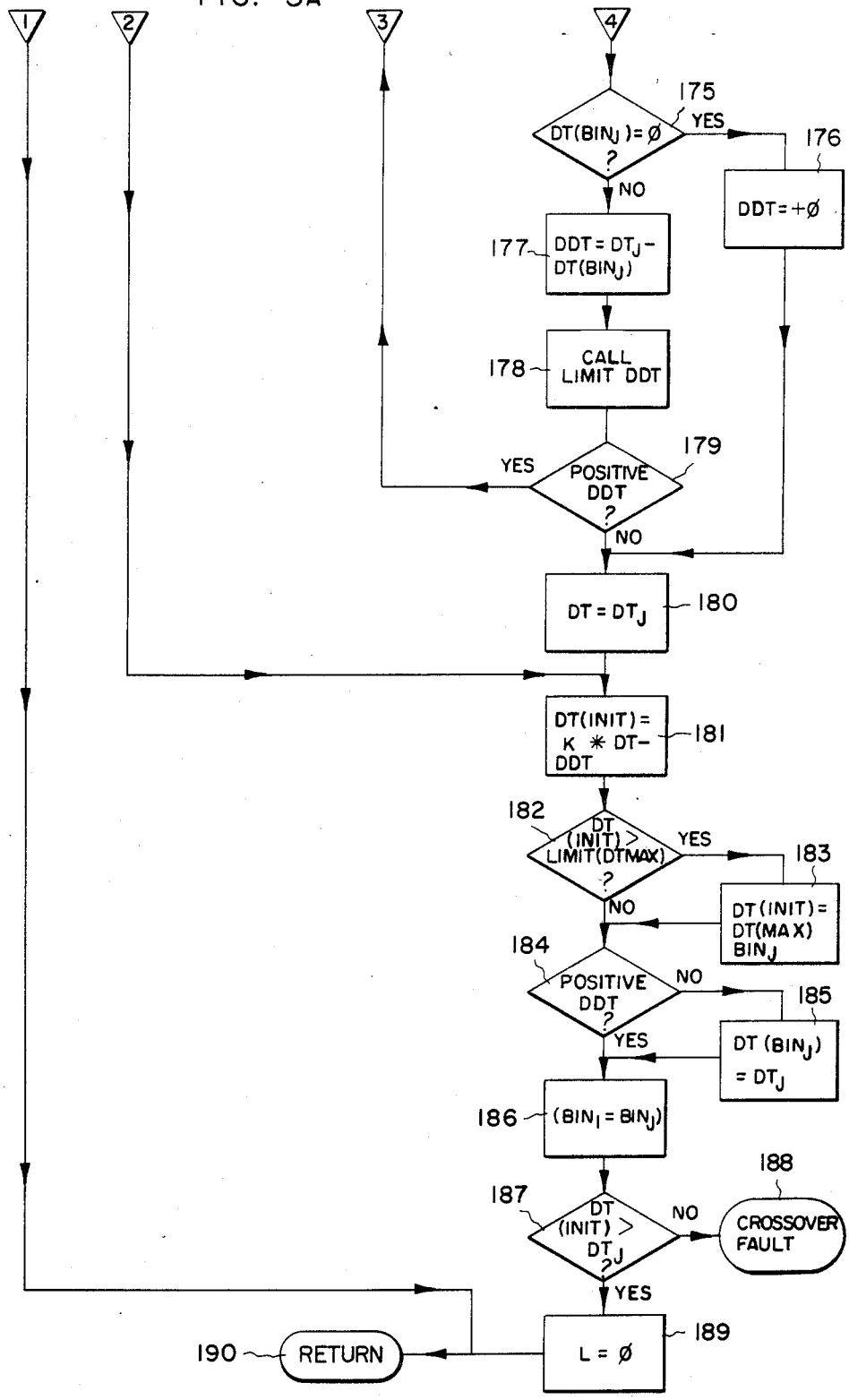
FIG. 5A completes the flow chart of FIG. 5.

A flow chart illustrating the control logic for implementing the main defrost algorithm of the subject invention is shown in FIGS. 4, 5, and 5A. In addition, the specific subroutine algorithms for determining fault conditions in the defrost cycle are included in FIGS. 6 through 10. As noted above, microcomputer 50 contains the machine language instructions stored in read-only memory (ROM) for carrying out each step shown in the flow charts. In the preferred embodiment, normal operation of the heat pump system in cooling or heating mode to maintain the comfort zone 20 at a selected setpoint temperature is controlled by a standard heat pump thermostat. The function of control 36 is thus primarily to effect defrost of the outdoor heat exchanger 27. In a further embodiment wherein control 36 and its microcomputer 50 include both the defrost and heat pump control programs, the two programs may be combined to provide continuous and total heating and cooling control. In this alternative embodiment, thermostat 35 is replaced with a zone temperature sensor. Microcomputer 50 would control all the components of the heat pump system in accord with a heat pump program stored in ROM, using an algorithm which need not be disclosed for a full understanding of the subject defrost control invention.

The program used by the defrost control is disclosed as a flow chart, starting with FIG. 4. Microcomputer 50 enters the defrost routine as shown in FIG. 4 at instruction block 100. The program first takes care of certain "bookkeeping" requirements in instructions 101 through 105. For example, in instruction 101, it checks to see if an internal timer has reached its time-out point for outputting control states for the reversing valve 22, and the outdoor fan 28. If the required time interval has elapsed, logic levels used for controlling relays 52 and 53 are output by control 36 as previously explained. Likewise, if an internal timer indicates that a predefined interval has elapsed and that it is time to output data contained in the random-access memory (for test or service purposes), those data are provided in accordance with instruction 105.

The actual defrost algorithm begins with instruction 106, in which a third internal timer is checked to determine if the prescribed time interval has elapsed between successive analog-to-digital conversions of the analog voltage signals developed across the outdoor temperature sensor 44 and outdoor heat exchanger coil temperature sensor 43 that are input to the microcomputer 50. If so, the microcomputer 50 accepts the temperature sensor input, performs an analog-to-digital conversion, and filters it so that these temperatures are available as digital values for further use in the algorithm. Otherwise, the program logic proceeds to instruction block 108 which checks to see whether a fault condition exists in the defrost cycle, i.e., whether a defrost fault flag has been "set". If the fault condition does exist, instruction 109 checks to see if the emergency heat-switch is on. As noted above, in the preferred embodiment, the emergency heat switch on thermostat 35 is used as the fault reset switch. Operator actuation of the emergency heat switch acts to reset the fault condition, clearing the fault flags, and as noted in instruction 110, also clears all fault counters. Use of the fault counters for purposes of detecting a fault condition will be explained below. If the fault condition exists but the emergency heat switch is not on, the emergency heat light 34 on thermostat 35 is caused to flash. It will be recalled that in the preferred embodiment, the emergency heat light 34 is caused to flash to indicate the occurrence of a defrost fault.

Should a fault condition not exist, or after all fault counters have been cleared according to instruction 110, program logic proceeds to instruction 112. This instruction checks to see if the compressor is energized, and if not, proceeds to instruction 139. Assuming that the compressor is energized, instruction 113 checks to see if the unit has been forced into defrost for service or test. If so, the defrost state is immediately actuated at instruction block 126.

Assuming that the system is not required to implement a forced defrost, instruction block 114 inquires to determine if the system is already operating in a defrost cycle. If so, the program logic transfers to instruction block 128 to see if termination of the defrost state is required. If defrost is not in process, instruction block 115 inquires whether the outdoor temperature is less than 45° F. A negative response indicates that frost and ice would not likely form on the outdoor heat exchanger 27 due to the relatively high ambient air temperature. In this case, the program logic would proceed to instruction block 139 to permit the heating cycle to continue. However, if the outdoor ambient air temperature is less than 45° F., instruction block 116 then determines if the outdoor heat exchanger coil temperature is less than or equal to 32° F. If not, the algorithm proceeds to instruction block 101, since frost and ice could not form on a coil that is above the freezing point of water.

Alternatively, instruction block 117 determines if 10 minutes have elapsed since the last defrost cycle. Once again, if less than 10 minutes have passed, logic again returns to the instruction block 101. Otherwise, instruction block 118 determines if the outdoor ambient air temperature is less than 6° F. At low outdoor ambient air temperatures, (less than 6° F.), the time required for ice to form on the heat exchanger surface is relatively long, due to the small amount of water vapor normally found in ambient air at such temperatures. In this case, there is no need to determine a normal defrost cycle initiate temperature, and program logic transfers to instruction block 122, to wait six hours before initiating a defrost cycle.

Conversely, if the outdoor ambient air temperature is between 6° F. and 45° F. and the heat exchanger temperature is less than or equal to 32° F., efficient operation of the temperature conditioning system requires that the defrost cycle be effected before sufficient frost and ice form on heat exchanger 27 to reduce its capacity below the demand for heat in the comfort zone 20. Accordingly, control logic proceeds to instruction block 119 to inquire if the system has just been energized. An affirmative response causes the logic to drop to instruction block 125 to wait at least 30 minutes before performing a defrost. This 30-minute period is determined by an internal timer in microcomputer 50, that is started when the system is first energized and after each defrost cycle is terminated. If the temperature conditioning system has been energized for at least 30 minutes, logic proceeds to instruction 120 where a subroutine is called to calculate the differential temperature between the outdoor ambient air and the outdoor heat exchanger, DT (initiate). Instruction block 121 determines if the value of DT (initiate) is greater than the current value for the differential temperature, $DT_J$. If not, the logic proceeds to instruction 126 where the defrost cycle is implemented. Otherwise, instruction block 122 again checks to determine if the outdoor ambient air temperature is less than 6° F. If this is the case, and if according to inquire 123, six hours have elapsed since the last defrost cycle, the program logic again immediately proceeds to instruction block 126 to implement a defrost cycle. If the outdoor ambient air temperature is not below 6° F. or if less than six hours have elapsed since the last defrost cycle, the program logic inquires in instruction block 124 whether a fault condition exists. If the fault condition exists and 30 minutes have elapsed since the last defrost, control 36 again implements an immediate defrost cycle in instruction block 126. In this fault mode, an elapsed time less than 30 minutes since the last defrost causes control to revert back to instruction block 101.

The instructions in block 126 effect a defrost cycle in which reversing valve 22 is set to the cool position, the emergency electric auxiliary heat elements 29 are energized, and the outdoor fan 28 is turned off. Instruction block 127 stops the acquisition of the outdoor ambient air temperature and the normal outdoor heat exchanger temperature, and instead acquires only the outdoor heat exchanger temperature during the defrost cycle.

In instruction block 128, a subroutine is called to calculate the terminate temperature, T, for the temperature of the defrosting outdoor heat exchanger 27 at which the defrost cycle should be terminated. An inquiry in instruction block 129 determines if the defrost cycle has continued for 10 minutes. If so, the system increments the fault counter in instruction block 134. Instruction block 135 checks to see if more than a predetermined number of fault counts have accumulated in the fault counter. If so, a fault condition exists so that instruction block 136 causes the emergency heat light on thermostat 35 to begin to flash. If the fault counter has accumulated less than the predetermined number of faults, program logic proceeds to instruction block 137.

Assuming that the defrost cycle has continued for less than 10 minutes, an inquiry is made in instruction block 130 to determine if the defrost was caused by a forced (or test) defrost. If so, instruction block 131 resets the defrost timer equal to one minute, the minimum defrost time for normal defrosts, and proceeds to inquiry 132. Otherwise, control logic transfers directly to instruction block 132 to inquire if the defrost timer equals one minute, i.e., did the system enter a defrost cycle one minute earlier. If not, control transfers back to instruction 101 at the program entry point. If the defrost timer equals one minute, instruction 133 determines if the coil temperature is greater than the calculated terminate temperature, T. If so, instruction 137 turns on the outdoor fan 28. A negative response to inquiry 133 causes control to revert back to instruction block 101 to wait for the outdoor heat exchanger to reach the terminate temperature or for 10 minutes to elapse, whichever comes first.

After instruction 137, inquiry 138 checks to see if the outdoor fan 28 has been on for 15 seconds. If not, control again reverts to instruction 101; otherwise, instruction 139 leaves the fan on, turns the emergency heat elements 29 off, and switches the reversing valve 22 over to the heating mode. Thereafter, instruction 140 clears all internal timers, resetting them back to 0.

Some of the more important aspects of the subject invention are disclosed in FIGS. 5 and 5A, wherein the valve for DT (initiate) is calculated. This subroutine starts with instruction block 151 wherein an inquiry is made to determine if 30 seconds have elapsed since the subroutine was last called. The 30-second time period (like the previously mentioned thirty and ten minute periods) is determined by an internal counter/timer is microcomputer 50, which relates time to the frequency of the time base reference, crystal 60. If less than 30 seconds have elapsed since the last entry, program logic returns to the defrost program as a result of instruction block 190, entering at instruction block 121. The affect of this is to prevent calculation of DT (initiate) except at 30 second intervals. Once the 30-second interval has elapsed, the program proceeds to instruction block 152 where the current differential temperature $DT_J$ is calculated by subtracting the value for the outdoor heat exchanger temperature from the outdoor ambient air temperature, these values being measured by temperature sensors 44 and 43, respectively. Thereafter, instruction block 153 obtains the current outdoor temperature "bin", represented by the variable, bin $_J$. The outdoor temperature bins are shown graphically in FIG. 2 as a series of consecutive outdoor temperature increments over the range from 6° F. through 47° F. The current outdoor temperature bin $_J$, is merely the particular increment in which the current outdoor temperature measured by sensor 44 lies. Associated with the bin $_J$ is a differential temperature minimum limit represented by $DT_{min}$ (bin $_J$). This differential temperature minimum limit is stored in read-only memory (ROM) and is represented graphically on FIG. 2 by the $F_2$ fault curve. Inquiry 155 then determines if the current differential temperature, $DT_J$ is less than the differential temperature minimum associated with the current outdoor temperature bin. If the answer is affirmative, program logic proceeds with instruction block 156 that represents the Lo DT Fault routine disclosed in FIG. 6.

Figure 6:
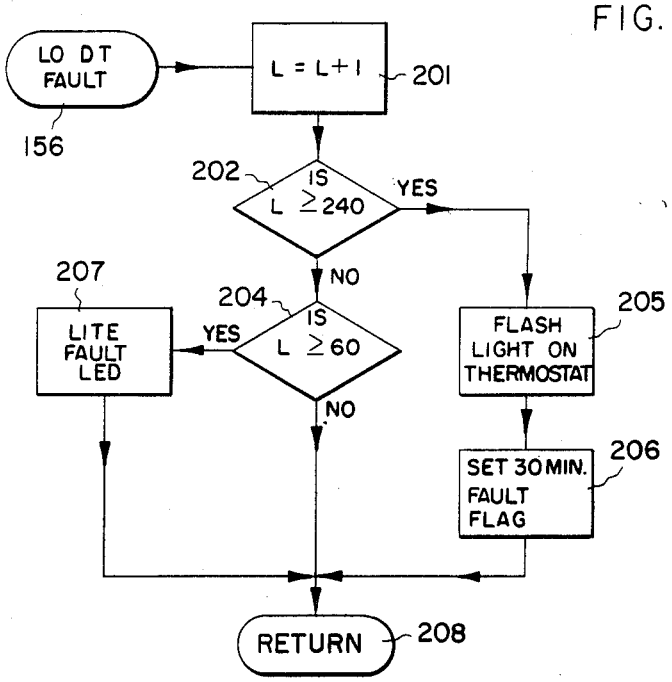
FIG. 6 is a flow chart illustrating the logic for determining a low differential temperature fault condition.
Figure 7:
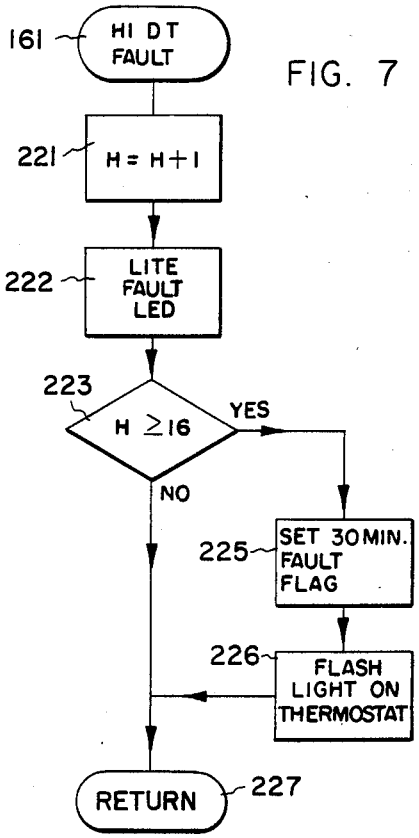
FIG. 7 is a flow chart illustrating the logic for determining a high differential temperature fault condition.

Referring now to FIG. 6, once this fault routine is entered, instruction block 201 increments a counter L by one additional count. Instruction 202 checks to see if L is greater than or equal to 240, and if so, instruction block 205 causes the fault light 34 on thermostat 35 to flash, and instruction 206 sets the 30-minute fault flag. Thereafter, control is returned to instruction block 121 by the "return" command of instruction 208. If L is less than 240 counts, instruction block 204 checks to see if L is greater than or equal to 60 counts. If so, the service light 59 on the control 36 is lighted to indicate to a serviceman that a fault has occurred in the defrost system. Thereafter, or if L is less than 60 counts, program logic returns once again to the main defrost program at instruction block 121. As can be seen, faults are indicated for service personnel via the LED on the defrost control 36 much sooner than the homeowner's indication via the emergency heat light 34 on the thermostat 35.

Referring back now to FIG. 5, if the current differential temperature $DT_J$ is not less than the minimum represented by the fault curve of F2 in the current outdoor ambient temperature bin, instruction 157 sets the counter L equal to 0. In an analogous fashion, instruction 158 obtains the differential temperature maximum limit for the current outdoor temperature bin, where these maximum limits are represented by the F1 fault curve in FIG. 2. Although curves F1 and F2 are represented therein as continuous functions, in the preferred embodiment, values for the minimum or maximum limits are actually stored as tabular values for each outdoor temperature bin.

Instruction 159 inquires to determine if 12 minutes have elapsed since the last defrost cycle. This insures that the outdoor heat exchanger coil temperature will have time to stabilize following the last defrost cycle before post defrost cycle differential temperatures are accepted. If the last defrost cycle has not occurred 12 minutes previously, program logic reverts to instruction block 164 which determines if more than 12 minutes have elapsed since the last defrost cycle. If not, program logic returns to the main defrost program at instruction block 121. Otherwise, more than 12 minutes must have elapsed since the last defrost cycle, resulting in program logic proceeding with instruction block 165.

Referring back to instruction block 159, if exactly 12 minutes have elapsed since the last defrost cycle, program logic proceeds with instruction block 160, wherein the current differential temperature is compared to the maximum limit for the current outdoor temperature bin. If the value of $DT_J$ is less than the maximum limit, program logic proceeds with instruction block 162. Otherwise, a high differential temperature fault exists, causing control to revert to the block represented by instruction 161. Block 161 represents the program shown in FIG. 7 starting with instruction 221 in which a counter H is incremented by one count. Thereafter instruction block 222 lights the service fault LED 59 on control 36 to indicate to a serviceman that a fault condition has occurred. Instruction 223 inquires if the counter H equals or exceeds 16 counts, and if so, instruction 225 sets the forced 30-minute fault flag, and instruction 226 flashes the fault indicator light 34 on thermostat 35. If the count value for H is less than 16 or after the fault indicator 34 is caused to flash, program logic returns to the main defrost program at instruction block 121. Turning back to FIG. 5, if the current differential temperature $DT_J$ is less than the maximum limit, instruction 162 sets the counter H equal to 0. Thereafter, instruction 163 determines if the current outdoor ambient temperature bin equals the previous outdoor temperature bin, and if not, proceeds to instruction block 166.

As explained above, if more than 12 minutes have elapsed since the last defrost cycle, instruction 165 determines if the current outdoor temperature bin is equal to the previous outdoor temperature bin. If not, program logic again proceeds with instruction block 166 wherein the change in the differential temperature, DDT, is set equal to a $-0$. In this case, the minus sign associated with the 0 value of DDT is used as a flag to show that the outdoor ambient air temperature has changed from one bin to another in successive determinations of the value for DT (initiate) temperature.

Instruction block 167 determines if the current differential temperature associated with the current outdoor ambient temperature for Bin $_J$ equals 0. This would occur after the heat pump system were initially energized and before a non-zero value had been stored in Bin $_J$ for the differential temperature at a given outdoor ambient air temperature. If the differential temperatures associated with the current outdoor temperature is not equal to 0, program logic proceeds to instruction block 174, wherein the differential temperature DT is set equal to the value stored in random-access memory for the current outdoor ambient air temperature. On the other hand, if the value stored in Bin $_J$ for the differential temperature DT does equal 0, inquiry 168 determines if the current differential temperature between the outdoor ambient air and the outdoor heat exchanger coil 28 is less than 0.5 times the maximum differential temperature associated with the current outdoor ambient air temperature Bin $_J$. If not, instruction 170 further determines if $\frac{1}{2}$ the maximum limit associated with Bin $_J$ is less than $\frac{1}{2}$ the previous DT (initiate) value. If the answer to inquiry 170 is affirmative, instruction 173 sets DT equal to $\frac{1}{2}$ the maximum limit associated with the outdoor ambient air temperature Bin $_J$.

Assuming that the answer to the previous inquiry 168 is affirmative, inquiry 169 determines if the current value for the differential temperature is less than $\frac{1}{2}$ the previous value for DT (initiate). An affirmative answer to inquiry 169 causes DT again to be set equal to $\frac{1}{2}$ the previous value for DT (initiate). A negative response to inquiry 169 causes instruction 171 to set DT equal to the current value $DT_J$ of the differential temperature between the outdoor ambient air and the outdoor heat exchanger coil 27.

It should be apparent that instructions 168 through 173 are used to establish an initial value for DT, when the outdoor ambient air temperature falls in a bin that does not yet have a value stored for the differential temperature, DT, for use in calculating DT (initiate); otherwise, instruction 174 merely sets DT equal to the previously stored value for DT in the current outdoor ambient air temperature Bin $_J$.

Proceeding on to FIG. 5A, an affirmative answer to the inquiry in instruction block 163 regarding whether the current Bin $_J$ equals the previous Bin $_J$ causes the program logic to proceed with inquiry 175. This instruction determines if the value for differential temperature associated with the current Bin $_J$ equals 0. An affirmative answer again indicates that the system has not completed a defrost cycle with the ambient air temperature falling in the range of the present Bin $_J$. An affirmative answer to inquiry 175 thus causes a branch to instruction 176, which sets the change in the differential temperature, DDT, equal to $+0$. Instruction 176 uses a plus sign in front of the 0 value stored in a temporary register for DDT as a flag to indicate that there was not a change in the outdoor temperature, causing a shift from one bin to another. Thereafter, program logic proceeds to instruction block 180.

However, if a previous defrost cycle has caused a post defrost value for DT to be stored in the memory associated with the current Bin $_J$, instruction 177 sets the value DDT equal to the current post defrost differential temperature $DT_J$, minus the stored value DT associated with Bin $_J$. The value DDT thus represents the change between the current post defrost differential temperature and the value for this parameter previously stored in the current outdoor ambient air temperature bin.

Figure 8:
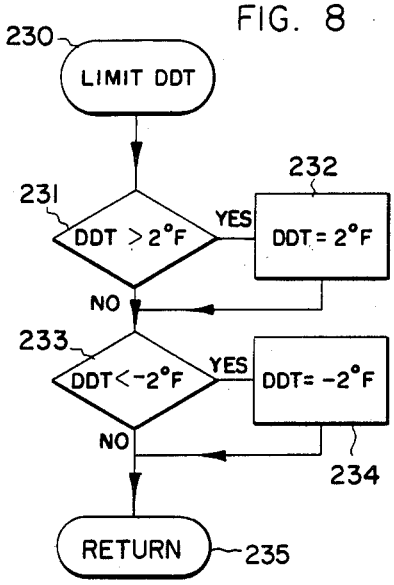
FIG. 8 is a flow chart illustrating the logic for determining a differential temperature limit fault.

Instruction 178 calls a subroutine to determine a maximum or a minimum limit for DDT. As shown in FIG. 8, inquiry 231 determines if DDT exceeds 2° F., and if so, sets the value of DDT equal to 2° F. in instruction 232. If the value of DDT is not in excess of 2° F., inquiry 233 determines if it is less than $-2°$ F. An affirmative response causes the value of DDT to be set equal to $-2°$ F. in instruction 234. The limit DDT subroutine then returns via instruction 235 to inquiry 179 on FIG. 5A.

Inquiry 179 checks to see if the value for DDT is positive, indicating that the current differential temperature between the outdoor ambient air and the outdoor heat exchanger 127 is greater than the value previously stored in Bin $_J$ for post defrost differential temperature, DT. An affirmative answer to this inquiry causes program logic to proceed to instruction block 174 in FIG. 5 which sets DT equal to the previous value stored for DT in the current Bin $_J$. A negative response to inquiry 179 causes instruction 180 to set DT equal to the value for the current post defrost differential temperature $DT_J$. Thus instructions 174 and 180 set DT equal to the minimum of the current post defrost differential temperature or previously stored post defrost differential temperature associated with the current outdoor ambient air temperature Bin $_J$.

Subsequently, instruction 181 sets the value for DT (initiate) equal to a present constant, K, times the value DT, minus the value, DDT. (K may typically range from 1.5 to 2.5, depending on the design of the heat pump system.) This value DT (initiate) is used in instruction 121 shown in FIG. 4, to determine if a defrost cycle should be initiated. Operation of the system to achieve an optimum DT (initiate) for each ambient temperature bin will be more clearly explained hereinbelow. It should be apparent that DT (initiate) can only be determined 12 minutes after a defrost cycle is completed, using the then current post defrost cycle differential temperature DT and the previously stored post defrost value, DT; and thereafter, is redetermined if a change in ambient air temperature causes a change in bins.

Instruction 182 inquires to determine if the value for DT (initiate) exceeds the maximum DT limit corresponding to the values of the F1 fault curve on FIG. 2, and if so, the value for DT (initiate) is set equal to that maximum limit for the current outdoor ambient air temperature Bin $_J$ in block 183. Imposition of a limit on DT (initiate) by instruction 183 would generally only occur at relatively low outdoor ambient air temperatures. Alternatively, inquiry 184 determines if the value for DDT is positive, occurring if the actual value calculated in instruction 177 were positive, or if DDT were set equal to a positive 0 in instruction 176. If so, the value representing previous outdoor ambient air temperature range Bin $_I$ is replaced with the value of the current Bin $_J$. A negative response to inquiry 184 results in instruction 185 setting the value for DT associated with the Bin $_J$ equal to the current differential temperature, $DT_J$. Thus the value retained for DT in each bin, is replaced by a lower value post defrost differential temperature $DT_J$, and over a period of time, the value for DT associated with each bin becomes a minimum for the heat pump system defrosted under control of the subject defrost control.

Figure 9:
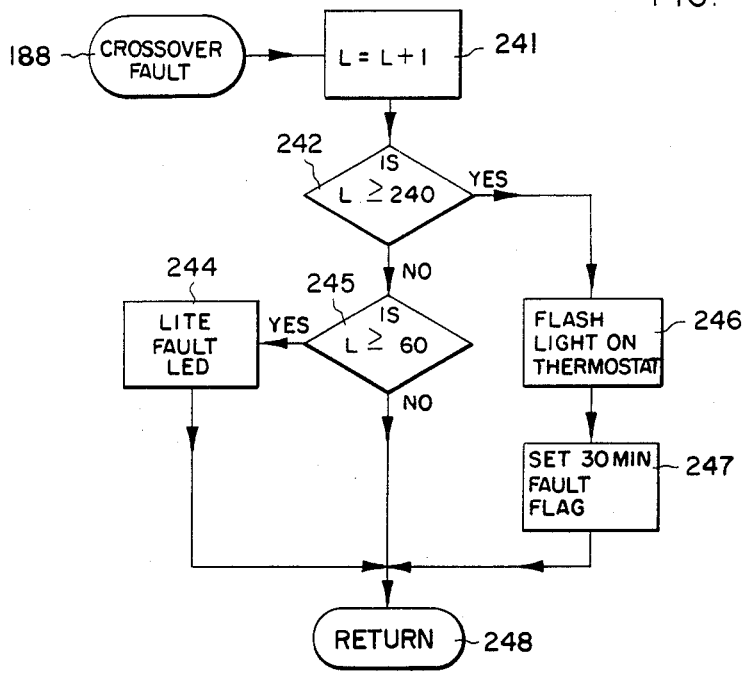
FIG. 9 is a flow chart illustrating the logic for determining the occurrence of a "cross-over" fault.

Following instruction 186, inquiry 187 determines if the value for DT (initiate) is greater than the current differential temperature $DT_J$. If not, a crossover fault is detected and is handled by instruction block 188 as shown in FIG. 9. The programming involved with a crossover fault is generally analogous to that previously discussed for the low differential temperature fault shown in FIG. 6. The logic of instruction blocks 201 through 208 is generally analogous to that of instruction blocks 241 through 248, and it should not be necessary to repeat the discussion of it herein. If following a defrost cycle, the value for $DT_J$ still exceeds the value DT (initiate), it should be apparent that the defrost cycle was unsuccessful in melting frost and ice from the outdoor heat exchanger coil 27. The crossover fault program checks this condition, and uses the same counter L for accumulating successive occurrences of this condition.

Assuming that the response to inquiry 187 is affirmative, instruction 189 resets the counter L to 0. Thereafter, instruction 190 causes the return of program logic to the main defrost program at instruction block 121 as previously noted.

Figure 10:
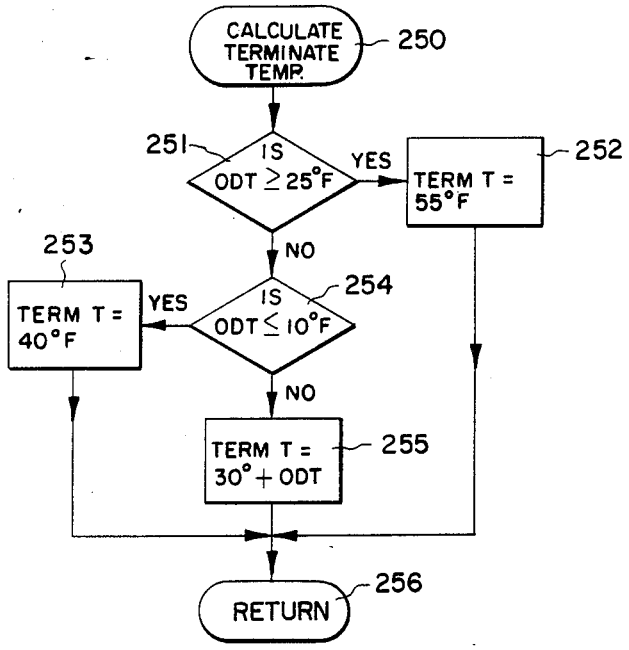
FIG. 10 is a flow chart illustrating the logic for determining a defrost cycle terminate fault.

Once program logic has caused the heat pump system to enter a defrost cycle, the temperature of the outdoor heat exchanger coil 27 is the primary parameter used for termination of the cycle. Instruction 133 checks to determine if the heat exchanger temperature exceeds a terminate temperature, T. As indicated above, the terminate temperature T is calculated in a subroutine called by instruction 128. FIG. 10 discloses the program steps involved in calculating the terminate temperature, T, starting with inquiry 251. This instruction checks to see if the outdoor ambient air temperature is greater than or equal to 25° F. If so, the terminate temperature is set equal to 55° F. by instruction 252; thereafter, program logic proceeds to return via instruction 256 to the main defrost program at instruction 129. However, if the outdoor ambient air temperature is less than 25° F., inquiry 254 checks further to determine if it is less than 10° F. An affirmative response to this inquiry causes instruction 253 to set the terminate temperature to 40° F. Otherwise, the terminate temperature T is set to the value, 30° F.+ODT, in instruction 255. In either case, program logic returns to the main defrost program via instruction 256 as noted above. Thus, the instructions encompassed under block 250 establish a terminate temperature in the range 40° F. to 55° F., as a function of the outdoor ambient air temperature.

To facilitate a better understanding of the operation of the subject defrost control, several operational points are shown on FIG. 2 that illustrate how the control algorithm approaches an optimum value in successive defrost cycles for a given outdoor ambient air temperature bin. In the example illustrated, it is assumed that the outdoor ambient air temperature, ODT, lies in the range from 31° to 34° F. It is further assumed that the system has carried out a previous defrost cycle resulting in the previous post defrost value for $DT_I$ being stored in the random-access memory associated with the outdoor ambient air temperature bin covering the range from 31° through 34° F. at the differential temperature point indicated by reference numeral 300. In addition, the current DT (initiate) value is represented by the point denoted by reference numeral 304. As frost builds up on the outdoor heat exchanger coil 27, the differential temperature between the outdoor ambient air and the outdoor heat exchanger coil increases until the value DT (initiate) is reached at 304, at which time the system is caused to enter a defrost cycle by the control. For an outdoor ambient air temperature at 33°, the terminate temperature, T, would equal 55° F. When the outdoor heat exchanger coil temperature reaches the terminate temperature, T, the defrost cycle is terminated. After 10 minutes and at 30-second intervals after the defrost cycle is terminated, a current value for the differential temperature, $DT_J$, is calculated according to instruction 152. Exactly 12 minutes after the defrost cycle is completed, instruction block 177 calculates a value for DDT equal to the value of the current $DT_J$ (at 301) minus the previous value $DT_I$ (at 300). The positive difference between the stored and currently measured differential temperature values indicates a loss of performance of the system between two consecutive defrosts, so that the original value of DT (initiate) at 304 is depressed to the value at 303 by the difference DDT between the value $DT_J$ at 301 and the value $DT_I$ at 300. This is indicative of a loss of performance in the defrost cycle, since apparently, frost remains on the coil that was not removed during the defrost cycle. A successive defrost cycle will be initiated at a lower differential temperature DT (initiate), at 303, and therefore typically after a shorter interval since the last defrost cycle than previously, to attempt to restore performance of the defrost cycle to the previously measured and stored best performance indicated by the value $DT_I$, at 300.

On the other hand, if following the second defrost cycle, a value of $DT_J$ is measured that is lower than the stored value $DT_I$, as is shown at point 302, the performance of the system has improved between the two consecutive defrosts. The DT (initiate) value is then allowed to increase by the quantity equivalent to the negative difference DDT between the current $DT_J$ at 302 and the previous $DT_I$ at 300 to the point 305, since the need for defrost has been reduced as indicated by the relatively lower differential temperature $DT_J$. This lower value of DT at 302 is then stored in the computer memory as the "best performance" measure of system performance after a defrost cycle for the particular outdoor temperature bin (or range) in which the value was obtained.

When the heat pump system and control 36 are initially energized, the values for DT stored in random-access memory for each of the outdoor temperature bins covering the range 6° F. through 47° F. are automatically set to 0. As the temperature conditioning system continues to operate, a value for differential temperature, DT, in each of these bins replaces the 0 value, and further, in successive defrost cycles for each bin, these DT values each approach a minimum. These minimum values collectively define a "dry coil" DT curve for the system as shown in FIG. 2. As the temperature conditioning system changes due to aging, the specific values for the minimum or dry coil DT curve may change, causing the optimum defrost initiate curve to change likewise. Thus, the defrost control changes with the heat pump system over time.

Each time the system is re-energized, the algorithm insures that after the system has been in operation for a short period of time, control 36 will initiate defrost according to an optimum criteria. This occurs because each time the heat pump system is deenergized, control 36 resets the random-access memory values for DT to 0; successive defrost cycles eventually redefine the optimum defrost initiate DT curve for the temperature conditioning system—and the optimum curve will correspond to the heat pump system operating characteristics as the system ages. Moreover, control 36 is adaptable to virtually any heat pump system requiring defrost of an outdoor heat exchanger coil, and does not require an operator adjustment for use with a specific system. Control 36 is adaptive to the temperature conditioning system with which it is used, and learns from each succeeding defrost cycle how the defrost initiate value, DT (initiate), should be adjusted to achieve an optimum defrost cycle for a particular ambient temperature range, represented by each of the ODT bins.

Under unusual circumstances, the performance of the system may continue to degrade following repeated defrost cycles, so that the differential temperature between the outdoor ambient air and the outdoor heat exchanger continues to increase in value, even after repeated and corresponding reductions in the DT (initiate) value. In this case, the value of DT (initiate) may eventually be exceeded by the currently measured $DT_J$. This represents a cross-over fault covered in instruction block 188 described above. This type of a fault may occur if the outdoor heat exchanger coil is exposed to freezing rain or blowing snow, causing increased ice and frost to form on the coils, or as the result of coil blockage by litter or weeds, or because of an outdoor fan failure. After 240 repetitions of this type of fault, the program forces the system to defrost every 30 minutes as compared to variable length cycles. The operator is warned that a fault condition has occurred when the light 34 on his thermostat 35 begins to flash. The operator has the option of clearing the fault condition by toggling the emergency heat (reset) switch on thermostat 35, thereby resetting all fault counters as noted in instructions 109 and 110. Typically, this would be done after the cause of the fault was corrected. Similar fault indication and reset capability are provided for each of the other types of defrost faults noted above and dicussed below.

Further protection against system malfunction is provided by determining if the DT (initiate) value exceeds a stored maximum limit value associated with each outdoor ambient temperature bin range as represented by the F1 fault curve in FIG. 2. These maximum limits for each outdoor ambient air temperature bin represent a high differential temperature between the outdoor ambient air and the outdoor heat exchanger that would occur if a fault condition exists that should be indicated on the consumer's thermostat 35. A fault of this nature may occur if, for example, the outdoor fan fails, or if a restriction in the refrigerant line should occur.

Should the differential temperature between the outdoor ambient air and the outdoor heat exchanger fall below a relatively low minimum value, control 36 will detect a fault indicative of an abnormal condition such as low refrigerant charge or compressor failure. The minimum levels for each outdoor ambient air temperature bin are stored in ROM and their values are represented by the F2 fault curve in FIG. 2.

Although the subject invention has been disclosed with respect to a preferred embodiment, modifications thereto will be readily apparent to those skilled in the art. Such modifications lie within the scope of the present invention as defined in the claims which follow.

We claim:

1. A defrost control for a temperature conditioning system that includes an outdoor heat exchanger, said control comprising:

a. an outdoor heat exchanger temperature sensor;

b. an outdoor ambient air temperature sensor; and c. means connected to both the outdoor heat exchanger temperature sensor and the outdoor ambient air temperature sensor and responsive thereto, for controlling the system to effect a defrost cycle to melt ice and frost that have collected on the outdoor heat exchanger when the heat exchanger was used as an evaporator, if the current differential temperature between the outdoor ambient air and the outdoor heat exchanger exceeds a defrost initiate value calculated after each defrost cycle as a function of:

i. a post defrost cycle differential temperature between the outdoor ambient air and the outdoor heat exchanger determined by the control means following the last defrost cycle, generally before new frost and ice formed on the outdoor heat exchanger; and ii. a minimum such post-defrost cycle differential temperature from differential temperatures determined following previous defrost cycles as in (i), at substantially the same outdoor ambient air temperature; whereby said defrost cycle initiate value reiteratively determined by said control means, in time approaches an optimum value that changes as the temperature conditioning system changes and thus adapts to maintain an optimum defrost cycle.

2. The control of claim 1 further comprising memory means for storing said post-defrost cycle minimum differential temperature.

3. The control of claim 2 wherein the minimum post-defrost cycle differential temperature associated with each of a plurality of outdoor air temperature ranges is stored in the memory means so that the control provides optimum defrost cycle operation at each range of outdoor ambient air temperature.

4. The control of claim 1 wherein the control means are operative to adjust the defrost initiate value for the next defrost cycle as a function of the performance of the system during the last defrost cycle, where said performance is determined by the difference between the last and the minimum post defrost cycle differential temperature.

5. The control of claim 1 wherein the control means are operative to effect a default defrost cycle if the post-defrost cycle differential temperature exceeds said initiate defrost value.

6. The control of claim 1 wherein the control means are operative to effect a default defrost cycle if the post-defrost cycle differential temperature determined after the last defrost cycle exceeds a predetermined maximum value.

7. The control of claim 1 wherein the control means are operative to effect a default defrost cycle if the current differential temperature is less than a predetermined minimum value.

8. The control of claim 1 further comprising means for indicating a defrost fault condition to a user, wherein the control means are further operative to cause the indicating means to indicate a defrost fault when a default defrost cycle is effected.

9. The control of claim 1 wherein the control means are operative to terminate the defrost cycle if the temperature of the outdoor heat exchanger exceeds a terminate value calculated as a function of the outdoor ambient air temperature.

10. The control of claim 1 wherein the control means are operative to terminate the defrost cycle a predetermined interval of time after it was initiated.

11. A defrost control for a heat pump system that includes an outdoor heat exchanger on which frost and ice may accumulate during operation of the system in a heating mode, said control comprising:

a. an outdoor air temperature sensor;

b. an outdoor heat exchanger temperature sensor; and c. control means connected to both the outdoor air temperature sensor and the outdoor heat exchanger temperature sensor and responsive thereto, for effecting operation of the heat pump system in a defrost cycle to melt frost and ice accumulated on the outdoor heat exchanger, and including memory means for storing data, said control means being operative to:

i. periodically determine a differential temperature between the outdoor air and the outdoor heat exchanger while the heat pump system is operating in the heating mode;

ii. store in the memory means a post defrost cycle differential temperature between the outdoor ambient air and the outdoor heat exchanger, for the last defrost cycle completed, determined when the outdoor heat exchanger temperature was stable and generally before new frost and ice formed on the outdoor heat exchanger;

iii. store in the memory means, for each of a plurality of ambient air temperature ranges, a minimum such post defrost cycle differential temperature between the outdoor air and the outdoor heat exchanger, determined as in (ii), for the previous defrost cycles that are in the same ambient air temperature range; and iv. determine a defrost initiate value as a function of the minimum post defrost cycle differential temperature for the current outdoor ambient air temperature range and the post defrost cycle differential temperature value for the last defrost cycle completed; whereby the control means effect a defrost cycle if the current differential temperature between the outdoor ambient air and outdoor heat exchanger exceeds said defrost initiate value, and thus achieve optimum defrost cycle control for each range of outdoor ambient air temperature by adapting the defrost initiate value to changes in the temperature conditioning system.

12. The control of claim 11 wherein the control means are further operative to adjust the defrost initiate value following each defrost cycle by the difference between the last post defrost cycle differential temperature and the minimum post defrost differential temperature, such that the defrost initiate value for the next defrost cycle compensates for either a loss or an improvement in the defrost performance of the system during the last defrost cycle.

13. The control of claim 11 wherein the control means are operative to effect a default defrost cycle if the post defrost cycle differential temperature for the last defrost cycle completed exceeds said defrost initiate value.

14. The control of claim 11 wherein memory means are operative to store a plurality of maximum differential temperature values, each corresponding to one of the ranges of outdoor ambient air temperature; and the control means are operative to effect a default defrost if said post defrost cycle differential temperature for the last defrost cycle completed exceeds the predetermined maximum value for the current range of outdoor ambient air temperatures.

15. The control of claim 11 wherein memory means are operative to store a plurality of minimum differential temperature values, each corresponding to one of the ranges of outdoor ambient air temperature; and the control means are operative to effect a default defrost if the current value of the differential temperature is less than the predetermined minimum value for the current range of outdoor ambient air temperatures.

16. The control of claim 11 further comprising means for indicating the occurrence of a defrost fault condition to a user, wherein the control means are further operative to cause the indicating means to indicate a defrost fault when a default defrost cycle is effected.

17. The control of claim 11 wherein the control means are operative to terminate the defrost cycle if the temperature of the outdoor heat exchanger exceeds a terminate value calculated as a function of the outdoor ambient air temperature.

18. The control of claim 11 wherein the control means are operative to terminate the defrost cycle a predetermined interval of time after it was initiated.

19. A method for controlling the defrost of an outdoor heat exchanger in a temperature conditioning system, comprising the steps of:

a. sensing the temperature of the outdoor heat exchanger;

b. sensing the outdoor ambient air temperature;

c. periodically determining the differential temperature between the outdoor ambient air and the outdoor heat exchanger; and d. controlling the system to effect a defrost cycle to melt ice and frost collected on the outdoor heat exchanger if the current differential temperature between the outdoor ambient air and outdoor heat exchanger exceeds a defrost initiate value calculated as a function of:

i. a post defrost cycle differential temperature between the outdoor ambient air and the outdoor heat exchanger, determined following the last defrost cycle when the outdoor heat exchanger temperature was stable; and ii. a minimum such differential temperature from differential temperatures determined following previous defrost cycles as in (i) and at substantially the same ambient air temperature whereby said defrost initiate value adapts to changes in the temperature conditioning system to maintain an optimum defrost cycle.

20. The method of claim 19 further comprising the step of adjusting the defrost initiate value to a lower value for determining when to effect the next defrost cycle, if the last post defrost cycle differential temperature is greater than the minimum post defrost cycle differential temperature, and to a greater value if the last post defrost cycle differential temperature is less than the minimum post defrost cycle differential temperature, where the former condition indicates a loss of defrost cycle performance, and the latter condition indicates an improvement in performance.

21. The method of claim 19 further comprising the step of storing in a solid state memory said minimum differential temperature.

22. The method of claim 21 further comprising the step of storing in the solid state memory the minimum differential temperature associated with each of a plurality of predefined outdoor air temperature ranges, to provide optimum defrost cycle operation at each outdoor ambient air temperature range.

23. The method of claim 19 further comprising the step of effecting a default defrost cycle if the post defrost cycle differential temperature determined after the last defrost cycle exceeds a predetermined maximum.

24. The method of claim 19 further comprising the step of effecting a default defrost cycle if the current differential temperature is less than a predetermined minimum.

25. The method of claim 19 further comprising the step of effecting a default defrost cycle if the post defrost cycle differential temperature for the last defrost cycle completed exceeds said defrost initiate value.

26. The method of claim 19 further comprising the step of indicating to a user that a defrost fault condition has occurred.

27. The method of claim 19 further comprising the step of terminating the defrost cycle when the outdoor heat exchanger temperature reaches a value determined as a function of the outdoor ambient air temperature.

28. The method of claim 19 further comprising the step of terminating the defrost cycle a predetermined interval of time after it is initiated.

* * * * *